US007579766B2

(12) United States Patent
Kim

(10) Patent No.: US 7,579,766 B2
(45) Date of Patent: Aug. 25, 2009

(54) ELECTRON EMISSION DEVICE WITH IMPROVED ELECTRON EMISSION STRUCTURE FOR INCREASING EMISSION EFFICIENCY AND LOWERING DRIVING VOLTAGE

(75) Inventor: You-Jong Kim, Suwon-si (KR)

(73) Assignee: Samsung SDI, Co., Ltd., Sunwon-si (KR)

( * ) Notice: Subject to any disclaimer, the term of this patent is extended or adjusted under 35 U.S.C. 154(b) by 567 days.

(21) Appl. No.: 11/192,232

(22) Filed: Jul. 27, 2005

(65) Prior Publication Data

US 2006/0022569 A1 Feb. 2, 2006

(30) Foreign Application Priority Data

Jul. 30, 2004 (KR) ..... 10-2004-0060604

(51) Int. Cl.
*H01J 1/62* (2006.01)
*H01J 63/04* (2006.01)

(52) U.S. Cl. ..... 313/495; 313/309; 313/311; 313/336; 313/351; 445/24

(58) Field of Classification Search ..... 313/309–311
See application file for complete search history.

(56) References Cited

U.S. PATENT DOCUMENTS

| | | | | |
|---|---|---|---|---|
| 5,869,169 | A * | 2/1999 | Jones | 428/213 |
| 5,938,495 | A | 8/1999 | Ito | |
| 6,075,315 | A * | 6/2000 | Seko et al. | 313/336 |
| 6,121,066 | A * | 9/2000 | Ju et al. | 438/20 |
| 6,400,068 | B1 * | 6/2002 | Jaskie et al. | 313/309 |
| 6,876,136 | B2 * | 4/2005 | Nishibayashi et al. | 313/309 |
| 2002/0033663 | A1 * | 3/2002 | Xu et al. | 313/495 |

* cited by examiner

*Primary Examiner*—Sikha Roy
(74) *Attorney, Agent, or Firm*—Christie Parker & Hale LLP

(57) ABSTRACT

An electron emission device includes first and second substrates facing each other with a predetermined distance, cathode electrodes formed on the first substrate, electron emission regions formed on the cathode electrodes, and gate electrodes placed over the cathode electrodes while interposing an insulating layer. The gate electrodes have opening portions exposing the electron emission regions on the first substrate. The electron emission region has a height compensation portion formed on the cathode electrode such that the width of the height compensation portion is reduced in a direction toward the second substrate. An electron emission layer covers the surface of the height compensation portion and contacts the cathode electrode such that the electron emission layer is electrically connected to the cathode electrode.

14 Claims, 4 Drawing Sheets

ELECTRON EMISSION DEVICE WITH IMPROVED ELECTRON EMISSION STRUCTURE FOR INCREASING EMISSION EFFICIENCY AND LOWERING DRIVING VOLTAGE

CROSS REFERENCE TO RELATED APPLICATION

This application claims priority to and the benefit of Korean Patent Application No. 10-2004-0060604 filed on Jul. 30, 2004 in the Korean Intellectual Property Office, the entire content of which is incorporated herein by reference.

BACKGROUND OF THE INVENTION

1. Field of the Invention

The present invention relates to an electron emission device, and in particular, to an electron emission device which has an improved electron emission structure to heighten the emission efficiency and lower the driving voltage.

2. Description of Related Art

Generally, electron emission devices are classified into a first type where a hot cathode is used as an electron emission source, and a second type where a cold cathode is used as the electron emission source.

Among the second type of electron emission devices known are a field emitter array (FEA) type, a surface conduction emission (SCE) type, a metal-insulator-metal (MIM) type, and a metal-insulator-semiconductor (MIS) type.

With the FEA type electron emission device, the electron emission regions are formed from a material that emits electrons under the application of an electric field, and that drives electrodes of cathode and gate electrodes are placed around the electron emission regions. When electric fields are formed around the electron emission regions due to the voltage difference between the two electrodes, electrons are emitted from the electron emission regions.

In some conventional FEA type electron emission devices, the electron emission regions are spindt-type with a sharp-pointed tip made commonly through depositing or sputtering molybdenum (Mo) in a vacuum. For example, U.S. Pat. No. 5,938,495 discloses a method of manufacturing field cold cathodes. The spindt-type electron emission region has a small size with a bottom diameter of about 0.5 μm, and a height of 0.5-1 μm.

A semiconductor fabrication process should be used to manufacture an electron emission device with the spindt-type electron emission regions. The processing steps are complicated with such highly specialized techniques, however, so that the production cost is increased, and it becomes difficult to enlarge the display area.

It has been recently proposed that the electron emission regions should be formed with a carbonaceous material having a low work function, such as carbon nanotube, graphite and diamond-like carbon, using a thick filming process like the screen printing. Electrons are easily emitted from the carbonaceous electron emission material on the surface of the electron emission regions so that the low voltage driving thereof can be made while allowing the display area to be enlarged.

However, with the electron emission device having the carbonaceous material-based electron emission regions, when an insulating material is screen-printed, dried and fired one or more times to form an insulating layer with a thickness of 5-30 μm, the height of the opening portion to be formed with the electron emission region, that is, the thickness of the insulating layer is established to be 5-30 μm. The thickness of the electron emission region formed through the screen printing, drying and firing within the opening portion, however, is established to be at best 3-4 μm.

Consequently, with the conventional electron emission device, the distance between the electron emission region and the gate electrode is enlarged so that the emission efficiency is deteriorated, and the driving voltage becomes heightened. Furthermore, as the opening portion has a relatively large height compared to the thickness of the electron emission region, some of the emitted electrons collide against the insulating layer so that the insulating layer is charged while distorting the trajectories of the electron beams. Furthermore, the emitted electrons partially collide against the gate electrodes, and are leaked so that the amount of electrons reaching the phosphor layers is decreased.

The electron emission regions are formed with a plane shape of a circle or a rectangle in accordance with the shape of the opening portions. The electric fields are not uniformly applied to the electron emission regions, but concentrated on the periphery thereof positioned closest to the gate electrodes. The electrons emitted from the periphery of the electron emission regions are diffused with a predetermined diffusion angle.

Consequently, the emitted electrons do not properly strike the target phosphor layers at the relevant pixels, but land on unintended incorrect color phosphor layers while light-emitting them, thereby deteriorating the screen image quality.

SUMMARY OF THE INVENTION

In one exemplary embodiment of the present invention, there is provided an electron emission device and a method of manufacturing the electron emission device which heightens the emission efficiency and lowers the driving voltage.

In another exemplary embodiment of the present invention, there is provided an electron emission device and a method of manufacturing the electron emission device which prevents the electrons emitted from the electron emission regions from colliding against the structure of an insulating layer and gate electrodes, thereby minimizing the distortion of electron beam trajectories and the leakage of current.

In still another exemplary embodiment of the present invention, there is provided an electron emission device and a method of manufacturing the electron emission device which makes the electrons emitted from the electron emission regions proceed straightly to thereby enhance the screen image quality.

In one exemplary embodiment, the electron emission device includes a substrate, electron emission regions on the substrate, driving electrodes controlling the electron emission regions. The electron emission regions each comprise a height compensation portion on a driving electrode having a width that is reduced in a direction away from the substrate, and an electron emission layer covering the surface of the height compensation portion and contacting the driving electrode to connect the electron emission layer to the driving electrode.

In another exemplary embodiment of the present invention, the electron emission device includes first and second substrates facing each other and separated by a predetermined distance, cathode electrodes formed on the first substrate, electron emission regions formed on the cathode electrodes, and gate electrodes placed over the cathode electrodes while interposing an insulating layer. The gate electrodes have opening portions exposing the electron emission regions on the first substrate. The electron emission region has a height compensation portion formed on the cathode electrode such that the width of the height compensation portion is reduced in a direction toward the second substrate, and an electron emission layer covering the surface of the height compensation portion and contacting the cathode electrode such that it is electrically connected to the cathode electrode.

In one exemplary embodiment, the height compensation portion includes the same material as the insulating layer.

The height compensation portion may also have a maximum height identical with the thickness of the insulating layer, which may be 5-30 μm.

The portion of the electron emission region positioned closest to the second substrate may substantially reach plane as the gate electrode.

In one exemplary embodiment, a second insulating layer is formed on the gate electrodes when the insulating layer is referred to as the first insulating layer, and a focusing electrode is formed on the second insulating layer. The etching rate of the first insulating layer is three or more times higher than the etching rate of the second insulating layer.

The electron emission layer is formed with a material selected from the group consisting of carbon nanotube, graphite, graphite nanofiber, diamond, diamond-like carbon, $C_{60}$, and silicon nanowire.

In a method of manufacturing the electron emission device, cathode electrodes are first formed on a substrate. An insulating layer is formed on an entire surface of the substrate such that it covers the cathode electrodes. Gate electrodes are then formed on the insulating layer such that planes of the gate electrodes cross the cathode electrodes to form crossed regions. The gate electrodes have at least one opening portion per the respective crossed regions of the gate and the cathode electrodes. At this time, a mask pattern is formed to form height compensation portions within the opening portions. Thereafter, the portions of the insulating layer not covered by the gate electrodes and the mask pattern are etched to simultaneously to form opening portions and height compensation portions. The mask pattern is removed, and an electron emission material is coated on the height compensation portions to form electron emission layers.

BRIEF DESCRIPTION OF THE DRAWINGS

The above and other features of the present invention will become more apparent by describing exemplary embodiments thereof in detail with reference to the accompanying drawings in which.

DETAILED DESCRIPTION OF EXEMPLARY EMBODIMENTS

The present invention will be described more fully hereinafter with reference to the accompanying drawings, in which exemplary embodiments of the invention are shown.

Figure 1:
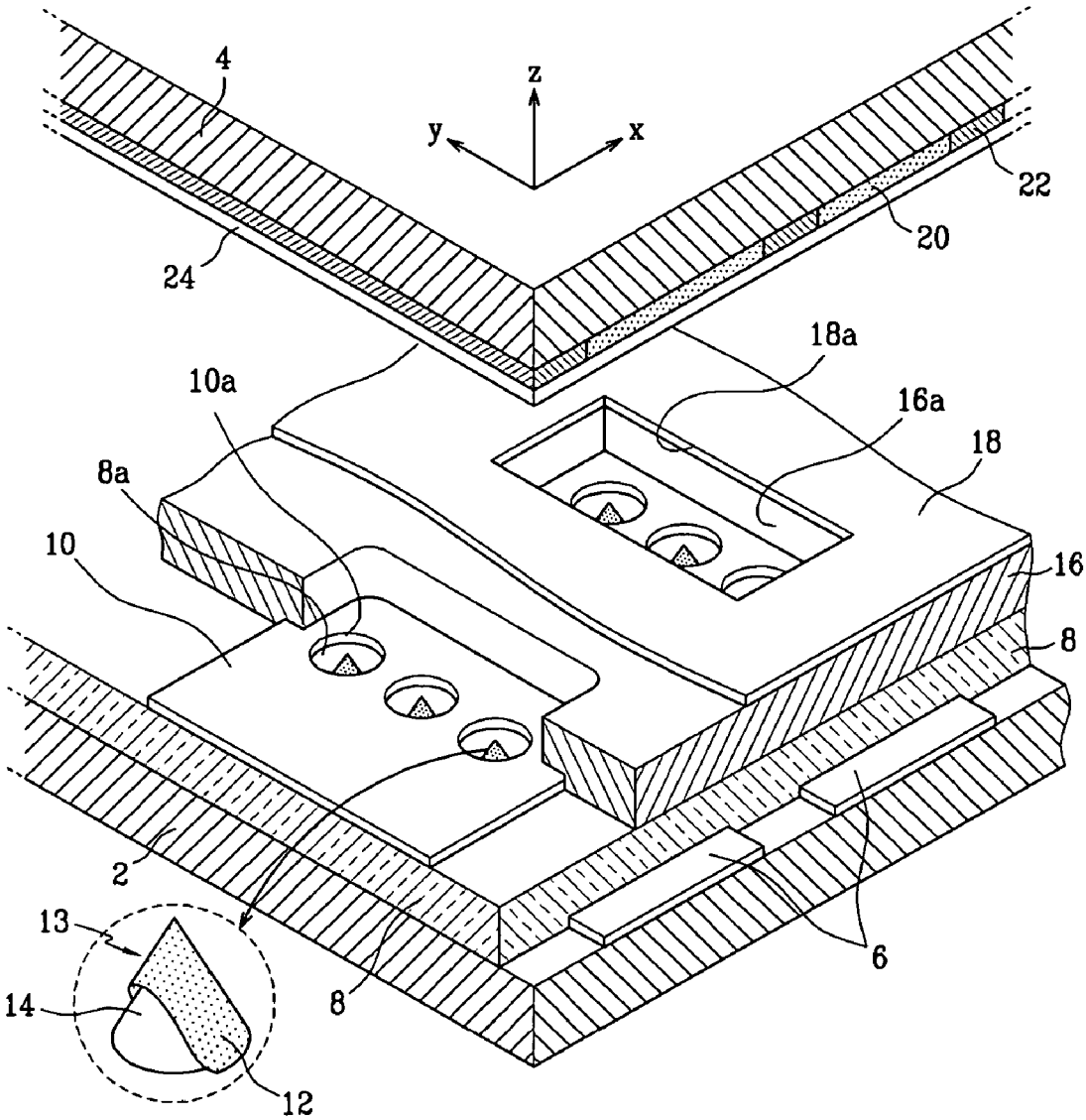
FIG. 1 is a partial exploded perspective view of an electron emission device according to an embodiment of the present invention.
Figure 2:
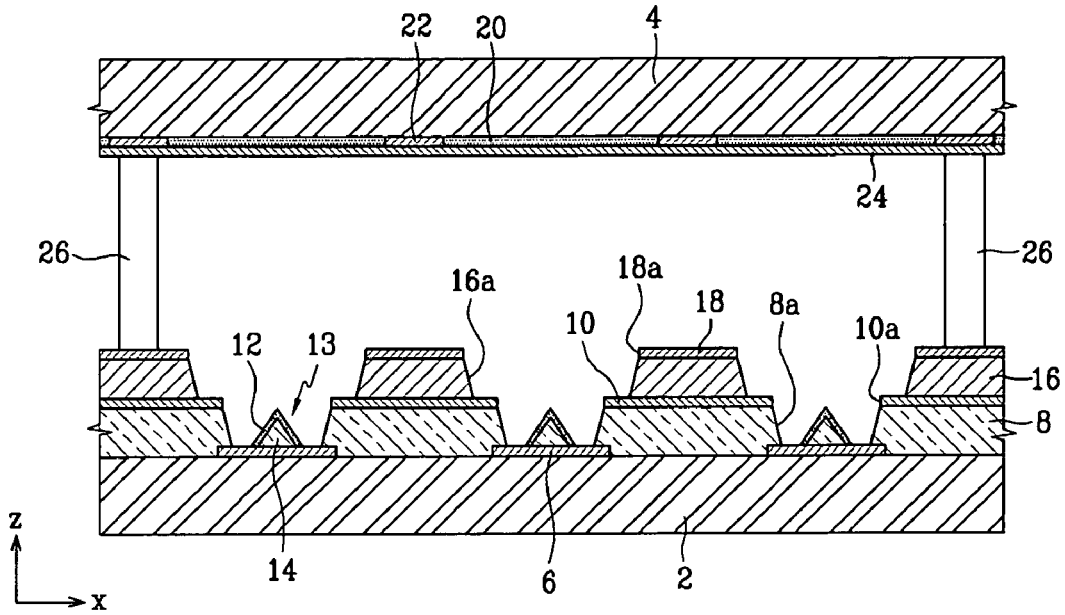
FIG. 2 is a partial sectional view of the electron emission device according to the embodiment of the present invention shown in FIG. 1.

As shown in FIGS. 1 and 2, the electron emission device includes first and second substrates 2 and 4 facing each other with a predetermined distance. An electron emission structure is provided at the first substrate 2 to emit electrons, and a light emission structure at the second substrate 4 to emit visible rays due to the electrons from the electron emission structure, thereby displaying the desired images.

First, cathode electrodes 6 are stripe-patterned on the first substrate 2 in a direction of the first substrate 2 (in the direction of the y axis of the drawing), and a first insulating layer 8 is formed on the entire surface of the first substrate 2 while covering the cathode electrodes 6. Gate electrodes 10 are formed on the first insulating layer 8.

The regions where the planes of the cathode and the gate electrodes 6 and 10 overlap are defined as the pixel regions. At least one electron emission region 13 is formed on the cathode electrode 6 at each pixel region. Opening portions 8*a* and 10*a* are formed at the first insulating layer 8 and the gate electrodes 10 corresponding to the electron emission regions 13, which exposes the electron emission regions 13 on the first substrate 2.

The electron emission region 13 has a height compensation portion 14 tapered from the cathode electrode 6 to the second substrate 4 while being gradually reduced in the width thereof, and an electron emission layer 12 covering the surface of the height compensation portion 14 contacting the cathode electrode 6 such that it is electrically connected to the cathode electrode 6.

In one embodiment, the height compensation portion 14 is formed with the same material as the first insulating layer 8. For instance, the height compensation portion 14 is simultaneously patterned with the opening portion 8*a* when the opening portion 8*a* is formed at the first insulating layer 8 through etching.

In one embodiment, the maximum height of the height compensation portion 14 is established to be the same as the thickness of the first insulating layer 8. Accordingly, when the electron emission layer 12 is placed on the surface of the height compensation portion 14, the portion of the electron emission layer 12 closest to the second substrate 4 is placed at the same plane as the gate electrode 10. In this embodiment, the height compensation portion 14 and the first insulating layer 8 have a thickness of 5-30 μm.

Figure 3:
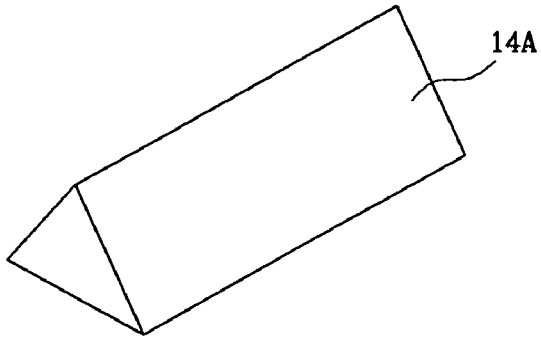
FIG. 3 is a perspective view illustrating a height compensation portion of the electron emission device according to an embodiment of the present invention.

The height compensation portion 14 has a sharp-pointed end directed toward the second substrate 4 such that the electron emission layer 12 is tapered toward the second substrate 4. For instance, the height compensation portion 14 is shaped as a cone. Alternatively, as shown in FIG. 3, the end of the height compensation portion 14A directed toward the second substrate may be linearly formed. In both cases, the sectional shape of the height compensation portion 14 and 14A substantially forms a triangle.

Figure 4:
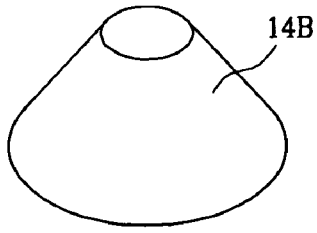
FIG. 4 is a perspective view illustrating a height compensation portion of the electron emission device according to another embodiment of the present invention.
Figure 5:
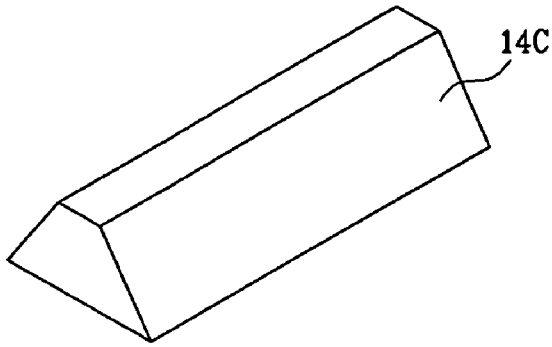
FIG. 5 is a perspective view illustrating a height compensation portion of the electron emission device according to yet another embodiment of the present invention.

Furthermore, as shown in FIGS. 4 and 5, the height compensation portion may have the basic structure shown in FIGS. 1-3, but with a top, flat surface directed toward the second substrate. In this case, the sectional shape of the height compensation portions 14B and 14C substantially forms a trapezoid.

Referring again to FIGS. 1 and 2, the electron emission layer 12 covers the surface of the height compensation portion 14 with a thickness of 0.2-2 μm. In this embodiment, the electron emission layer 12 is formed with a material emitting electrons under the application of an electric field, such as a carbonaceous material and a nanometer-sized material. The electron emission layer 12 may be formed with carbon nanotube, graphite, graphite nanofiber, diamond-like carbon, $C_{60}$, silicon nanowire, or a combination thereof.

A second insulating layer 16 and a focusing electrode 18 are formed on the gate electrodes 10 and the first insulating layer 8, and opening portions 16*a* and 18*a* are formed at the second insulating layer 16 and the focusing electrode 18 while exposing the electron emission regions 13 on the first substrate 2. The opening portions 16*a* and 18*a* of the second insulating layer 16 and the focusing electrode 18 are provided at the respective pixel regions defined on the first substrate 2 one by one, thereby surrounding the plurality of electron emission regions 13.

In one embodiment, the first and the second insulating layers 8 and 16 are formed with materials differentiated in etching rate with respect to an etching solution or gas such that the opening portions 16*a* of the second insulating layer 16, the opening portions 8*a* of the first insulating layer 8 and the height compensation portions 14 can be formed through one etching process. The etching rate of the first insulating layer 8 with respect to the etching solution or gas for the second insulating layer 16 can be established to be higher than that of the second insulating layer 16 by three times or more.

With the formation of the height compensation portion 14 on the cathode electrode 6 and the electron emission layer 12, covering the height compensation portion 14, even if the height of the opening portion 8*a* receiving the electron emission region 13, that is, the thickness of the first insulating layer 8 is largely established to be 5-30 μm, the minimum distance between the electron emission region 13 and the gate electrode 10 can be reduced, and the electron emission region 13 can be structured to bear a sharp-pointed end, on which the electric field is concentrated.

Red, green and blue phosphor layers 20 are formed on a surface of the second substrate 4 facing the first substrate 2 while being spaced apart from each other by a predetermined distance. Black layers 22 are formed between the phosphor layers 20 to enhance the screen contrast. An anode electrode 24 is formed on the phosphor layers 20, and the black layers 22 are formed with a metallic layer (for instance, an aluminum-based layer) through deposition.

The anode electrode 24 receives a high voltage required for accelerating the electron beams from the outside, and reflects the visible rays radiated from the phosphor layers 20 to the first substrate 2 toward the second substrate 4, thereby enhancing the screen luminance.

The anode electrode may be formed with an ITO-based transparent conductive film, in the place of the metallic layer. In this case, the anode electrode is formed on a surface of the phosphor layers and the black layers facing the second substrate. The anode electrode may be patterned with a plurality of portions.

Spacers 26 are arranged between the first and the second substrates 2 and 4, and the first and the second substrates 2 and 4 are sealed to each other at their peripheries using a sealant (not shown), such a glass frit. The space between the first and the second substrates 2 and 4 is in a vacuum state, thereby constructing an electron emission device. The spacers 26 are placed at the non-light emission area where the black layers 22 are located.

With the above-structured electron emission device, when predetermined driving voltages are applied to the cathode and the gate electrodes 6 and 10, electric fields are formed around the electron emission regions 13 due to the voltage difference between the two electrodes so that electrons are emitted from the electron emission regions 13. The emitted electrons are focused due to the minus (−) voltage of several tens volts applied to the focusing electrode 18 in the direction where the diffusion angle becomes smaller. The emitted electrons are attracted by the high voltage applied to the anode electrode 24, and migrated toward the second substrate 4, thereby colliding against the phosphor layers 20 at the relevant pixels to light-emit them.

With the electron emission device according to this embodiment of the present invention, the minimum distance between the electron emission region 13 and the gate electrode 10 (measured to be the horizontal distance between the sharp-pointed end of the electron emission region and the gate electrode) can be uniformly reduced due to the shape of the compensation portion 14 and the electron emission layer 12. Consequently, electrons are easily emitted from the electron emission regions 13 so that the emission efficiency of the electron emission regions 13 becomes heightened, and the driving voltage becomes lowered.

Furthermore, with the electron emission device according to this embodiment of the present invention, electric fields are concentrated on the sharp-pointed ends of the electron emission regions 13, and a large amount of electrons are emitted from those ends so that the amount of electrons collided against the first and the second insulating layers 8 and 16 to thereby charge them or collided against the gate electrodes 10 to be thereby leaked can be minimized. The electrons proceed straightly toward the second substrate 4 so that the striking of the incorrect color phosphors becomes minimized, and the color representation of the screen becomes enhanced.

With an electron emission layer 12 formed through the screen printing, drying and firing, the electron emission material is liable to be buried by the solid particles while not exposed to the surface thereof, thereby deteriorating the emission efficiency. Therefore, an adhesive tape (not shown) can be placed on the electron emission structure and detached from the latter, to partially remove the surface of the electron emission layer 12 such that the electron emission material is exposed to the surface of the electron emission layer 12.

Even when the opening portions 8*a* and 16*a* of the first and the second insulating layers 8 and 16 are formed with a large depth due to the shape of the height compensation portion 14 and the electron emission layer 12, the above-described surface treatment may be easily made, thereby enhancing the emission efficiency.

A method of manufacturing the electron emission device according to the embodiment of the present invention will be now explained with reference to FIGS. 6A to 6E.

Figure 6A:
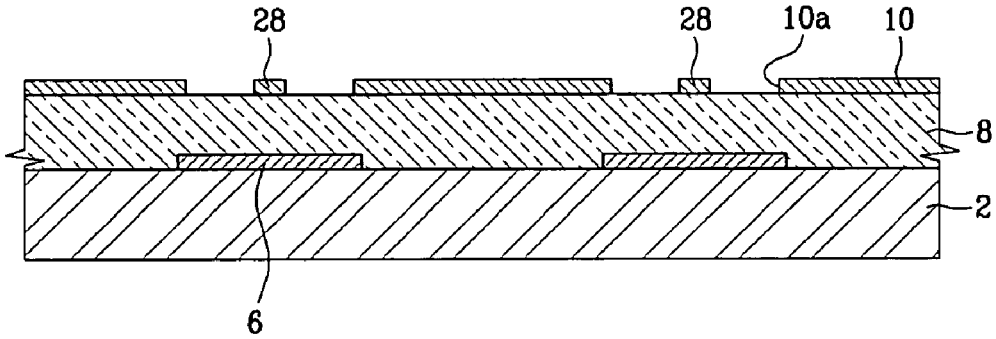
FIGS. 6A to 6E schematically illustrate the steps of manufacturing the electron emission device according to an embodiment of the present invention.

First, as shown in FIG. 6A, cathode electrodes 6 are stripe-patterned on the first substrate 2, and a first insulating layer 8 is formed on the entire surface of the first substrate 2 such that it covers the cathode electrodes 6. The first insulating layer 8 may be formed with a thickness of 5-30 μm through performing the steps of screen-printing, drying and firing several times.

Gate electrodes 10 are stripe-patterned on the first insulating layer 8 in a direction crossing the cathode electrodes 6. The gate electrodes 10 have at least one opening portion 10*a* at the respective pixel regions where the gate and the cathode electrodes 10 and 6 cross each other, and when the gate electrodes 10 are patterned, a mask pattern 28 for forming the height compensation portion is formed together with the opening portions 10*a*. That is, the mask pattern 28 is formed with the same material as the gate electrodes 10.

Figure 6B:
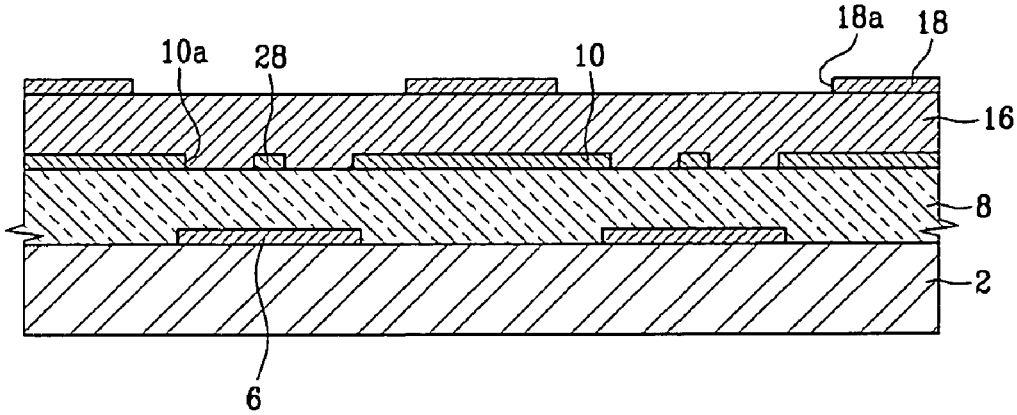

Thereafter, as shown in FIG. 6B, a second insulating layer 16 is formed on the first insulating layer 8 and the gate electrodes 10. The second insulating layer 16 may be also formed with a thickness of 5-30 μm through performing the steps of screen-printing, drying and firing several times. A conductive material is coated onto the second insulating layer 16, and patterned to thereby form a focusing electrode 18 with opening portions 18*a*.

The first and the second insulating layers 8 and 16 are formed with materials differentiated in etching rate with respect to an etching solution or gas. In this embodiment, the etching rate of the first insulating layer 8 is established to be higher than the etching rate of the second insulating layer 16 by three times or more.

Figure 6C:
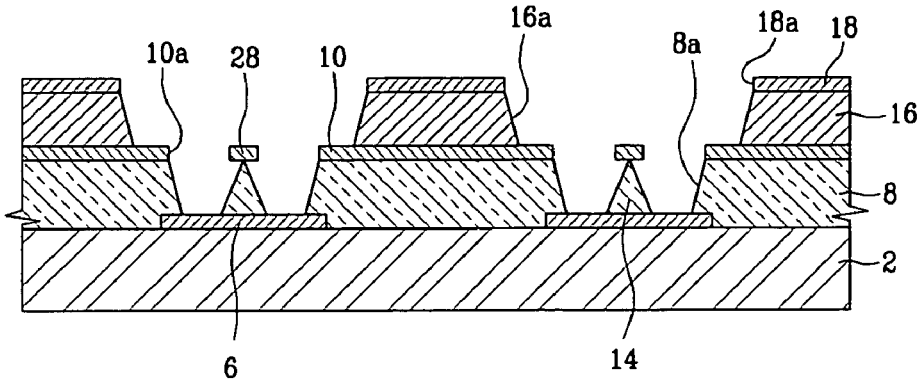

As shown in FIG. 6C, the second and the first insulating layers 16 and 8 are sequentially etched using an etching solution to sequentially form opening portions 16*a* and 8*a* for the second and the first insulating layers 16 and 8. At this time, the mask pattern 28 prevents the underlying first insulating layer 8 from being etched to thereby form height compensation portions 14. As the wet etching using an etching solution is conducted in an isotropic manner, the width of the opening portions 8*a* of the first insulating layer 8 is gradually reduced as it goes closer to the first substrate 2, and the width of the height compensation portions 14 is gradually enlarged as it goes closer to the first substrate 2.

The shape of the height compensation portion 14 is varied depending upon the plane shape of the mask pattern 28. As the mask pattern 28 is reduced in size, the end of the height compensation portion 14 becomes further sharp-pointed. The opening portions 8*a* and 16*a* for the first and the second insulating layers 8 and 16 and the height compensation portions 14 may be completed through one etching process due to the etching rate characteristics of the first and the second insulating layers 8 and 16.

Figure 6D:
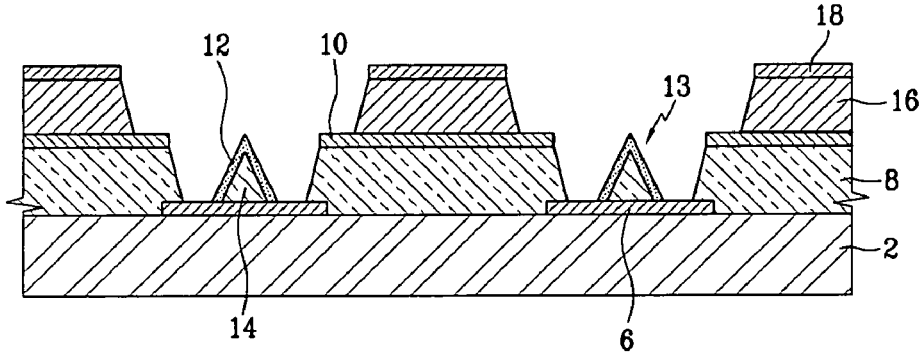

The mask pattern 28 is removed, and as shown in FIG. 6D, and an electron emission material is coated on the surface of the height compensation portions 14 to thereby form electron emission layers 12. When the electron emission layer 12 is formed, the electron emission material is sufficiently coated up to the bottom of the height compensation portion 14 such that the electron emission layer 12 contacts the cathode electrode 6.

A carbonaceous material or a nanometer-sized material may be used as the electron emission material. In order to form the electron emission layers 12, an organic material of vehicle or binder is mixed with a powdered electron emission material to prepare a paste-phased mixture with a viscosity suitable for the printing. The mixture is selectively printed onto the height compensation portions 14 using a screen mesh (not shown). The printed mixture is then dried, and fired.

Figure 6E:
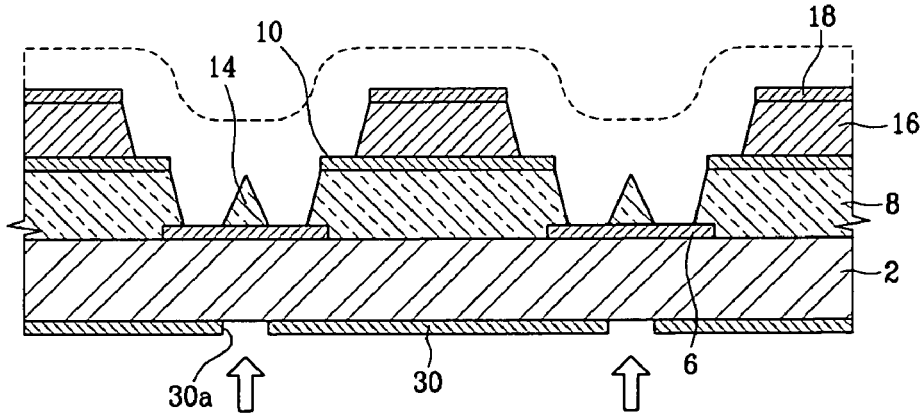

Alternatively, with the formation of the electron emission layers 12, as shown in FIG. 6E, the organic material and a photosensitive material are mixed with a powdered electron emission material to prepare a paste-phased mixture with a viscosity suitable for the printing. The mixture is screen-printed onto the topmost portion of the structure with a thickness (see the dotted line), and a mask pattern 30 is placed at the rear of the first substrate 2 with opening portions 30*a* corresponding to the height compensation portions 14. Ultraviolet rays are illuminated to the mixture through the backside of the first substrate 2 to selectively harden the mixture applied to the surface of the height compensation portions 14. The non-hardened mixture is removed, followed by drying and firing the target.

The light exposure mask 30 may be placed at the front of the first substrate 2. If the light exposure mask 30 is placed at the rear of the first substrate 2, the first substrate 2 is formed with a transparent material, the cathode electrodes 6 are formed with an ITO-based transparent conductive film, and the height compensation portion 14 is formed with a transparent insulating material.

Alternatively, it is also possible that after the cathode electrodes 6, the first insulating layer 8, the gate electrodes 10 and the mask pattern 28 are formed on the first substrate 2 as shown in FIG. 6A, the first insulating layer 8 may be etched to simultaneously form the opening portions and the height compensation portions. After the mask pattern 28 is removed, an electron emission material is coated onto the height compensation portions to form electron emission layers, thereby completing an electron emission structure with no focusing electrode.

In a method according to one embodiment of the present invention, the opening portions 8*a* of the first insulating layer 8, and the height compensation portions 14 can be formed simultaneously. When the first and the second insulating layers 8 and 16 satisfy the above-described etching condition, the opening portions 16*a* of the second insulating layer 16, the opening portions 8*a* of the first insulating layer 8 and the height compensation portions 14 can be formed through one etching process, thereby simplifying the processing steps.

Although exemplary embodiments of the present invention have been described in detail hereinabove, it should be clearly understood that the invention is not limited to the disclosed embodiment, but to the contrary, is intended to cover various modifications and equivalent arrangements will still fall within the spirit and scope of the present invention, as defined in the appended claims, and equivalents thereof.

What is claimed is:

1. An electron emission device comprising:

a substrate;

electron emission regions on the substrate;

a driving electrode on the substrate for controlling the electron emission from the electron emission regions;

an insulating layer on the substrate and having openings exposing the electron emission regions, the insulating layer comprising a different material than the substrate;

a height compensation portion on the driving electrode such that the width of the height compensation portion is reduced in a direction away from the substrate, the height compensation portion comprising the same material as the insulating layer; and an electron emission layer covering a surface of the height compensation portion and contacting the driving electrode such that the electron emission layer is electrically connected to the driving electrode.

2. The electron emission device of claim 1, wherein the height compensation portion has a sectional shape substantially of a triangle.

3. The electron emission device of claim 1, wherein the electron emission layer comprises a material selected from the group consisting of carbon nanotube, graphite, graphite nanofiber, diamond, diamond-like carbon, $C_{60}$, and silicon nanowire.

4. The electron emission device of claim 1, wherein the height compensation portion has a sectional shape substantially of a trapezoid.

5. The electron emission device of claim 1, wherein the width of the height compensation portion is gradually reduced farther from the substrate.

6. The electron emission device of claim 1, wherein a substantially whole area of a base of the height compensation portion contacts the driving electrode.

7. An electron emission device comprising:

first and second substrates facing each other by a predetermined distance;

cathode electrodes on the first substrate;

electron emission regions on the cathode electrodes;

gate electrodes placed over the cathode electrodes, the gate electrodes having opening portions exposing the electron emission regions on the first substrate;

an insulating layer on the first substrate between the gate electrodes and the cathode electrodes and comprising a different material than the first substrate;

phosphor layers on the second substrate; and at least one anode electrode on one surface of the phosphor layers;

wherein the electron emission regions each comprise a height compensation portion comprising the same material as the insulating layer on the cathode electrode such that the width of the height compensation portion is reduced in a direction toward the second substrate, and an electron emission layer covering the surface of the height compensation portion and contacting the cathode electrode such that the electron emission layer is electrically connected to the cathode electrode.

8. The electron emission device of claim 7, wherein the height compensation portion has a maximum height equal to the thickness of the insulating layer.

9. The electron emission device of claim 8, wherein the height compensation portion has a maximum height of 5-30 μm.

10. The electron emission device of claim 7, wherein the portion of the electron emission region positioned closest to the second substrate substantially reaches a plane of the gate electrode.

11. The electron emission device of claim 7, wherein the insulating layer is a first insulating layer, the electron emission device, further comprising:

a second insulating layer formed on the gate electrodes; and a focusing electrode formed on the second insulating layer, wherein the etching rate of the first insulating layer is three or more times higher than the etching rate of the second insulating layer.

12. The electron emission device of claim 7 wherein the electron emission layer comprises a material selected from the group consisting of carbon nanotube, graphite, graphite nanofiber, diamond, diamond-like carbon, $C_{60}$, and silicon nanowire.

13. The electron emission device of claim 7, wherein the width of the height compensation portion is gradually reduced closer toward the second substrate.

14. The electron emission device of claim 7, wherein a substantially whole area of a base of the height compensation portion contacts the cathode electrode.

* * * * *